United States Patent [19]

Bigelow

[11] 4,115,129

[45] Sep. 19, 1978

[54] ORGANOPHOSPHINE SULFIDES AS PHOTOGRAPHIC SENSITIZERS

[75] Inventor: John Howard Bigelow, Rochester, N.Y.

[73] Assignee: E. I. Du Pont de Nemours and Company, Wilmington, Del.

[21] Appl. No.: 847,006

[22] Filed: Oct. 28, 1977

Related U.S. Application Data

[63] Continuation of Ser. No. 618,694, Oct. 1, 1975, abandoned.

[51] Int. Cl.[2] ..... G03C 1/28

[52] U.S. Cl. ..... 96/107

[58] Field of Search ..... 96/107

[56] References Cited

U.S. PATENT DOCUMENTS

| | | | |
|---|---|---|---|
| 3,338,712 | 8/1967 | Thurston | 96/107 |
| 3,895,951 | 7/1975 | Riester et al. | 96/107 |
| 3,915,714 | 10/1975 | Saleck et al. | 96/107 |

*Primary Examiner*—Won H. Louie, Jr.

[57] ABSTRACT

Photographic colloid-silver halide emulsions are chemically sensitized by digestion at pH≧ 7 and the addition prior to or during digestion of at least one organophosphine sulfide of the general formula:

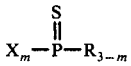

wherein (A) R is individually selected from the group consisting of hydrogen and a monovalent organic radical; *m* is 0, 1 or 2; and not more than one of said R's is hydrogen when *m* is 0; X represents a group having the formula:

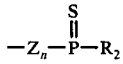

wherein Z is a divalent organic radical, *n* is 0 or 1, or (B) $X_m$ and $R_{3-m}$ together comprise a single trivalent heterocyclic radical.

35 Claims, No Drawings

ORGANOPHOSPHINE SULFIDES AS PHOTOGRAPHIC SENSITIZERS

This is a continuation of application Ser. No. 618,694 filed Oct. 1, 1975, now abandoned.

BACKGROUND OF THE INVENTION

1. Field of the Invention:

This invention relates to improved photographic silver halide emulsions. More particularly, it relates to photographic silver halide emulsions having increased speed and improved stability over emulsions made heretofore. Still more particularly, the invention relates to photographic silver halide emulsions chemically sensitized with organophosphine sulfides.

2. Prior Art:

It is known to chemically sensitize silver halide emulsions with a variety of chemical compounds, e.g., noble metal compounds, compounds providing labile sulfur or selenium, ethylene oxide polymers, etc. Chemical sensitization is considered to result from the formation of silver sulfide specks on the silver halide crystals resulting from the presense of labile sulfur or from the formation of silver specks on the silver halide crystals resulting from the presence of a reduction sensitizer, and is thereby differentiated from spectral sensitization, in which dyes are used to extend sensitivity into further regions of the spectrum, as is well known in the art.

The sensitizing activity of sulfur on silver halide emulsions has been well documented and those compounds which have been disclosed and which contribute labile sulfur in the system include thiosulfates, polythionates ($S_xO_6^{=}$ where $x$ = a whole number from 2 to 5 inclusive), e.g. tetrathionate, thioureas, e.g. allyl thiourea, mercapto compounds, etc. Reference may be had to: Mees and James, *The Theory of the Photographic Process,* Third Edition, The Macmillian Company, New York (1966). Sulfur sensitization occurs during digestion if labile sulfur compounds are present which decompose during the digestion stage to form the minute specks of silver sulfide on the silver halide crystals as described above. Heretofore, the labile sulfur compounds were initially present in the gelatin as naturally occurring substances or they were added in the form of the above ions to so-called inert gelatin used as the colloid carrier for the silver halide crystals to form the emulsion.

It is known to use organic phosphites in conjunction with labile sulfur to sensitize photographic silver halide emulsions and this is taught by Thurston, U.S. Pat. No. 3,338,712 patented Aug. 29, 1967.

Dunn, U.S. Pat. No. 3,297,446 patented Jan. 10, 1967 shows the use of organic tertiary phosphine compounds as antifoggants in silver halide emulsion systems using a synergistic sensitization combination of labile selenium and a noble metal.

Dunn, U.S. Pat. No. 3,442,653 patented May 6, 1960 teaches the use of triphenyl phosphine as an activating agent for non-labile selenium compounds in silver halide emulsions.

French Patent Pub. No, 2,201,484 describes trisubstituted organophosphine sulfides as supersensitizers for merocyanine dyes in the spectral sensitization of silver halide emulsions.

SUMMARY OF THE INVENTION

It has now been discovered that certain organophosphine sulfides will chemically sensitize silver halide photographic emulsions if the compounds are added prior to or during digestion and digestion is carried out at a pH of at least 7.0. According to this invention, therefore, there is provided a photographic, colloid-silver halide emulsion digested at a pH of at least 7 and chemically sensitized with an organophosphine sulfide added prior to or during digestion of the emulsion and having the formula:

$$X_m-\overset{\overset{\displaystyle S}{\|}}{P}-R_{3-m}$$

wherein (A) R is individually selected from the group consisting of hydrogen and a monovalent organic radical; $m$ is 0, 1 or 2; and not more than one of said R's is hydrogen when $m$ is 0; X represents a group having the formula:

$$-Z_n-\overset{\overset{\displaystyle S}{\|}}{P}-R_2$$

where Z is a divalent organic radical, and $n$ is 0 or 1 or (B) $X_m$ is $R_3 - m$ together comprise a single trivalent heterocyclic radical. The organophosphine sulfides of the invention have been found to be particularly efficacious chemical sensitizers for fast negative type emulsions; however, they may also be used in other silver halide emulsions such as those used in the graphic arts, e.g., lithographic materials, those used in radiographic work, e.g., X-ray films, color films, photographic films used for diffusion transfer processes, etc., and may comprise silver chloride, iodide, bromide, iodobromide, chlorobromide, etc. The invention relates to any such silver halide emulsion having an organophosphine sulfide chemical sensitizer of the invention added prior to or during digestion and which was digested at a pH of at least 7.0.

DESCRIPTION OF THE PREFERRED EMBODIMENTS

The invention provides novel photographic silver halide materials and also a method of chemically sensitizing such materials by adding a sensitizing amount of an organophosphine sulfide of the type defined above and under the conditions defined above.

The organophosphine sulfides may be added at any stage of the preparation of the silver halide emulsions prior to digestion, e.g., during precipitation of the silver halides, or after the washing and redispersion stage, or during digestion. The organophosphine sulfides may be added during emulsion preparation conveniently from any common organic solvent such as benzene, trichloromethane, ethyl alcohol, acetone, etc. A convenient solvent is a mixture of alcohol and acetone. The organophosphine sulfides of the invention have the general formula:

$$X_m-\overset{\overset{\displaystyle S}{\|}}{P}-R_{3-m}$$

wherein (A) R is individually selected from the group consisting of hydrogen and a monovalent organic radical; $m$ is 0, 1 or 2; and not more than one of said R's is hydrogen when $m$ is 0; X represents a group having the formula:

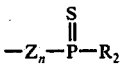

wherein Z is a divalent organic radical and $n$ is 0 or 1, or (B) $X_m$ and $R_{3-m}$ together comprise a single trivalent heterocyclic radical. By "individually selected from" it is meant that the R's may be the same or different. Typical radicals useful as R are substituted and unsubstituted groups of the following types: alkyl, cycloalkyl, alkenyl, cycloalkenyl, alkoxy, aryl, and amines; primary, secondary, and cyclic amines. The R's may be linked, as in the case of cyclic amines. The following structures represent divalent and monovalent groups which may be used for Z and the R's respectively.

RADICALS $C_2H_5O$—, $C_2H_5$—, $CH_3$—, —$CH_2CH_2$—, —$CH_2$—, H—, $CF_3CH_2O$—, —$CH_2CH_2CH_2$—, —$OCH_3$, —CH = $CH_2$, $CH_3CH_2CH_2CH_2O$—, —NH—, —$CH_2CH_2Cl$, —CH = CH—, $(CH_3)_2N$—, and $C_6H_5$—. As used herein "$C_6H_5$—" means "phenyl." Other radicals including the following:

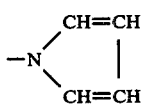

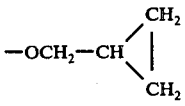

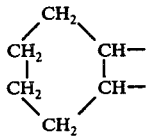

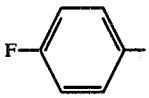

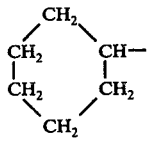

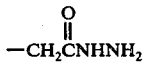

$(CH_3)_2N$—

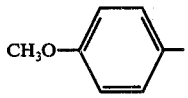

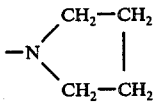

An example of a single trivalent heterocyclic radical which $X_m$ and $R_{3-m}$ together may form is

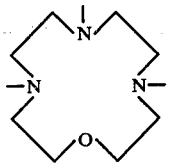

Preferred for R are linear aliphatic groups, heterocyclic groups, or aryl groups having 1–8 carbon atoms. Preferred heterocyclic groups have 5–12 membered rings with from 1 to 4 hetero atoms in the ring selected from nitrogen and oxygen. Preferred for Z are linear or cyclic aliphatic groups having 1–8 carbon atoms or —NH—.

Among the organophosphine sulfides suitable for use in the present invention the following are illustrative:

| Compound No. | Formula |
|---|---|
| 1 | 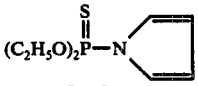 |
| 2 | $(C_2H_5)_2P(=S)-P(=S)(C_2H_5)_2$ |
| 3 | $(CH_3)_2P(=S)-P(=S)(CH_3)_2$ |
| 4 | $\phi_3P=S$ (where $\phi$ is $C_6H_5$—, i.e., phenyl) |
| 5 | $\phi_2P(=S)-CH_2CH_2P(=S)\phi_2$ 1,2-bisdiphenyl phosphino ethane disulfide |
| 6 | 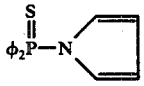 Diphenylpyrryl phosphine sulfide |
| 7 | $\phi_2P(=S)-CH_2P(=S)-\phi_2$ |
| 8 | $\phi_2P(=S)-H$ |
| 9 | 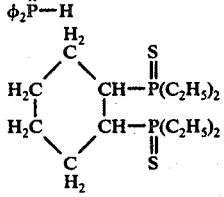 |
| 10 | 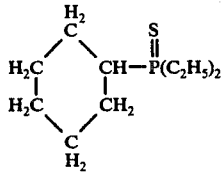 |
| 11 | $\phi_2P(=S)-OCH_3$ |
| 12 | $\phi P(=S)(OCH_3)_2$ |
| 13 | $\phi_2P(=S)-NH-P(=S)\phi_2$ |
| 14 | $\phi_2P(=S)-CH_3$ |
| 15 | 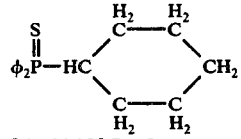 |
| 16 | $[(CH_3)_2N]_3P=S$ |
| 17 | $(CF_3CH_2O)_2P(=S)-P(=S)(OCH_2CF_3)_2$ |
| 18 | $\phi_2P(=S)CH_2CH_2CH_2P(=S)\phi_2$ |

-continued

| Compound No. | Formula |
|---|---|
| 19 | 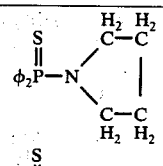 |
| 20 | $\phi_2P(=S)-CH=CH_2$ |
| 21 | $(CH_3CH_2CH_2CH_2O)_3P=S$ |
| 22 | 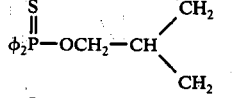 |
| 23 | 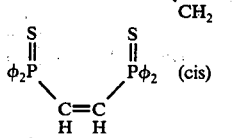 (cis) |
| 24 | 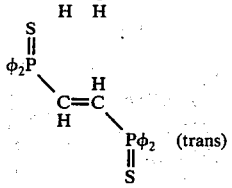 (trans) |
| 25 | 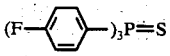 |
| 26 | $\phi_2P(=S)-CH_2-C(=O)-NH-NH_2$ |
| 27 | $\phi_2P(=S)-CH_2CH_2Cl$ |
| 28 | 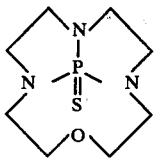 |
| 29 | 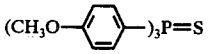 |
| 30 | $\phi_2P(=S)-P(=S)\phi_2$ |
| 31 | $\phi P(=S)(CH_2CH_2P(=S)\phi_2)_2$ |

For the preparation of the above organophosphine sulfide compounds reference may be had to: Kosolapoff, *Organophosphorus Compounds,* John Wiley & Sons, New York (1950) and Kosolapoff & Maier, *Organic Phosphorus Compounds,* Wiley-Interscience, Volumes I through V. Generally, the compounds are readily prepared by the addition of elemental sulfur to the corresponding phosphine.

As indicated above, the organophosphine sulfides may be added to a variety of silver halide emulsions and said emulsions may contain optical sensitizing dyes, antifoggants and other chemical sensitizers including conventional sulfur, noble metal, and reduction type sensitizers. The quantity of organophosphine sulfide will, of course, depend upon the particular type of emulsion and the desired effect and can vary within wide limits. The optimum amount to be added can be determined for each emulsion by simple experiment as is customary in the art of emulsion manufacture. Generally, the most suitable concentration will be found to be from $3 \times 10^{-5}$ and $3 \times 10^{-3}$ mole per 1.5 moles of silver halide in the emulsion.

The following procedures and examples will serve to illustrate the invention in a more detailed manner.

The organophosphine sulfide compounds were added to silver halide emulsions during the precipitation of the silver halides, during the redispersion after washing the emulsions to remove unwanted water-soluble salts resulting from the precipitation of the silver halides, or during the digestion period.

Silver halide emulsions were prepared according to the following procedures.

PROCEDURE A

Silver Chlorobromide Emulsion Make

A gelatino-silver chlorobromide emulsion was made by rapidly adding to an acidified gelatin solution containing 1.5 moles of potassium chloride, 1.5 moles of silver nitrate in aqueous solution. There was then added 0.6 mole of potassium bromide in aqueous solution and the mixture was allowed to ripen for 10 minutes, after which 0.9 moles of potassium bromide in aqueous solution was added and the emulsion was allowed to ripen an additional 10 minutes all at 160° F. The emulsion was cooled, coagulated, washed and redispersed in the manner disclosed in Moede, U.S. Pat. No. 2,772,165.

PROCEDURE B

Silver Iodobromide Make

A gelatino-silver iodobromide emulsion containing 1.6 mole percent silver iodide was made by rapidly pouring an aqueous solution containing 1.5 moles of silver nitrate and 3.0 moles of ammonia into an aqueous gelatin solution containing 1.5 moles of potassium bromide and the required amount of potassium iodide. The resulting emulsion was ripened for 5 minutes at 135° F., and then the ammonia was neutralized with acetic acid. The emulsion was cooled, coagulated, washed and redispersed in the manner disclosed in Moede, U.S. Pat. No. 2,772,165.

PROCEDURE C

Unsensitized Negative Type Emulsion Remelt

To a silver halide emulsion containing the equivalent of 1.5 moles of silver nitrate and made by Procedures A or B above there was added bulking gelatin and the temperature was raised to 130° F. The pH was adjusted to 8 with borax and the mixture was digested for 40 minutes at 130° F. The pH was adjusted to 5.5, coating aids including gelatin hardeners were added and the emulsions were coated on a photographic quality film base and dried in a conventional manner.

PROCEDURE D

Sensitized Negative Type Emulsion Remelt

To a silver halide emulsion containing the equivalent of 1.5 moles of silver nitrate and made by Procedures A or B above there was added bulking gelatin and the temperature was raised to 110° F. The pH was adjusted to 6.5. The emulsion was heated to 125° F., and there was added $3.3 \times 10^{-6}$ mole of gold sensitizer in the form of gold chloride, and $1.74 \times 10^{-5}$ mole of the sulfur sensitizing, sodium thiosulfate. After the addition of sensitizers the emulsion pH was about 7. The emulsion was then digested for 60 minutes at 125° F. The pH was then adjusted to 5.5; coating aids including a gelatin hardener were added; and the emulsions were coated on a photographic quality film support and dried in a conventional manner.

EXAMPLE 1

To the aqueous gelatin solution containing 1.5 mole of potassium bromide and potassium iodide of Procedure B there was added $4.57 \times 10^{-4}$ mole of compound 1, of the list of organophosphine sulfides above per 1.5 moles of silver halide. The emulsion was remelted as described in Procedure D. A second emulsion was made, remelted and coated similarly but without the phosphine sulfide compound to serve as a control. Both emulsions contained the gold and sulfur sensitizers. The coated strips were exposed in a sensitometer through a $\sqrt{2}$ step wedge equivalent to 4470 meter-candle-seconds and developed for 2 minutes at 68° F. in a conventional metol-hydroquinone developer and fixed, washed and dried. Sensitometric results are shown in the following table. The strips were tested fresh and after being aged for 7 days in an oven at 120° F. and 65% relative humidity.

The data show that the organophosphine sulfide provides improved response in both fresh and oven aged material.

TABLE 1

| Coating No. | Compound Added | Test Age | $D_{min.}$ | $D_{max.}$ | Speed Dens. = 1.0 |
|---|---|---|---|---|---|
| 1 | None-Control | Fresh | .03 | 3.34 | 100 |
| | | Oven | .03 | 2.94 | 110 |
| 2 | $4.57 \times 10^{-4}$ Compd. 1 | Fresh | .03 | 3.18 | 146 |
| | | Oven | .04 | 2.92 | 157 |

EXAMPLE 2

To the two aqueous gelatin solutions containing the potassium chloride solution in Procedure A there was added per 1.5 moles of silver halide, $8.27 \times 10^{-4}$ mole of Compound 2 and $1.08 \times 10^{-3}$ mole of Compound 3, respectively, from the above list of organophosphine sulfides. Another emulsion was made without the compounds to serve as a control. The emulsions were remelted according to Procedure C. The strips were exposed in a sensitometer through a $\sqrt{2}$ step wedge by means of a quartz-iodine lamp which provided an exposure of 514,000 meter-candle-seconds. The strips were processed for 1½ minutes at 80° F. in a commercial, high contrast, hydroquinone-formaldehyde bisulfite developer. The sensitometric results are shown in the following table.

TABLE 2

| Coating No. | Additive | $D_{min.}$ | $D_{max}$ Dens. | $D_{max}$ Step No. |
|---|---|---|---|---|
| 1 | None-control | .04 | .03 | 20 |
| 2 | $8.57 \times 10^{-4}$ Compd. 2 | .17 | 2.87 | 13 |
| 3 | $1.08 \times 10^{-3}$ Compd. 3 | .43 | 2.63 | 9 |

The data show that the organophosphine sulfides are active sensitizers in the absence of other chemical sensitizers.

EXAMPLE 3

Example 1 was repeated except that the organophosphine sulfides indicated by number in the table were added during the digestion stage of Procedure D in place of the sulfur sensitizer in amount of $3.4 \times 10^{-4}$ mole per 1.5 moles of silver halide. The sensitometric strips were exposed and developed as described in Example 1 to give the following results.

TABLE 3

| Ctg. No. | Compd Added | Test Age | $D_{min.}$ | $D_{max.}$ | Density At Step #2 | Density Retained |
|---|---|---|---|---|---|---|
| 1 | None-Control | Fresh | .03 | 1.43 | .30 | |
| | | Oven | .04 | 1.38 | .17 | 57% |
| 2 | Compound 22 | Fresh | .25 | 1.93 | .88 | |
| | | Oven | .17 | 2.06 | .65 | 74% |
| 3 | Compound 11 | Fresh | .09 | 1.53 | 1.16 | |
| | | Oven | .10 | 1.22 | 1.06 | 91% |
| 4 | Compound 9 | Fresh | .02 | 1.51 | .42 | |
| | | Oven | .02 | 1.54 | .19 | 45% |
| 5 | Compound 23 | Fresh | .09 | 2.08 | 1.75 | |
| | | Oven | .03 | 2.46 | .99 | 57% |
| 6 | Compound 24 | Fresh | .07 | 2.07 | 1.48 | |
| | | Oven | .04 | 2.60 | .99 | 68% |

These data illustrate the response and stability obtained by addition of the organophosphine sulfide compounds compared with conventional gold and sulfur sensitizers.

EXAMPLE 4-A

Two gelatino-silver chlorobromide emulsions were made as described in Procedure A above. The emulsions were remelted according to Procedure D, one containing the conventional gold sensitizer and $3.4 \times 10^{-4}$ mole of labile sulfur and the second emulsion contained was added $3.4 \times 10^{-4}$ mole of Compound 5 from the above list in place of the sulfur sensitizer. The sensitometric strips were exposed and tested as described in Example 1. The results are tabulated in the table below. The coatings were oven aged for 6 days at 120° F. and 65% relative humidity, plus one day at 152° F. and 90% relative humidity.

TABLE 4 - A

| Ctg. No. | Additive | Test Age | $D_{min.}$ | $D_{max.}$ |
|---|---|---|---|---|
| 1 | Control | Fresh | .03 | 1.12 |
| | Conventional Sulfur Sens. | Oven | .46 | 1.32 |
| 2 | Compound 5 | Fresh | .06 | 1.99 |
| | | Oven | .04 | 2.02 |

EXAMPLE 4-B

Three silver iodobromide emulsions were made as described in Example 1 except that $3.4 \times 10^{-4}$ mole of Compounds 5 and 6 above per 1.5 moles of silver halide were added to the emulsions during digestion remelted according to Procedure D above. One emulsion contained a conventional gold and sulfur sensitizer and the other two contained the conventional gold sensitizer and the organophosphine sulfide compounds indicated below in place of the sulfur sensitizer. The strips were tested as described in Example 1. The results are shown in the following table. The aging conditions were as described in 4-A.

TABLE 4 - B

| Coating No. | Additive | Test Age | $D_{min.}$ | $D_{max.}$ |
|---|---|---|---|---|
| 1 | Control | Fresh | .05 | 2.65 |
| | | Oven | .67 | 2.08 |
| 2 | Compound 5 | Fresh | .04 | 2.79 |
| | | Oven | .04 | 2.85 |
| 3 | Compound 6 | Fresh | .07 | 3.65 |
| | | Oven | .05 | 2.97 |

The data indicate that the organophosphine sulfide compounds afford more stable emulsions.

EXAMPLE 5

Example 4B was repeated adding compounds 26, 27 and 28 in amounts of $3.4 \times 10^{-4}$ per 1.5 moles of silver halide to the silver iodobromide during digestion to the remelt stage. The control contained $3.4 \times 10^{-4}$ moles of labile sulfur sensitizer. The sensitometric strips were exposed through a $\sqrt{2}$ step wedge at $10^{-6}$ seconds in an Edgerton, Germeshausen, and Greer flash tube sensitometer Mark VII and developed for 2 minutes at 68° F. in a conventional metol-hydroquinone developer, fixed, washed and dried. Test results are shown in the table.

TABLE 5

| Coating No. | Additive | $D_{min.}$ | $D_{max.}$ | Speed (Dens. = 1.0) |
|---|---|---|---|---|
| 1 | Control | .04 | 1.86 | 100 |
| 2 | Compound 26 | .02 | 2.41 | 251 |
| 3 | Compound 27 | .02 | 2.09 | 259 |
| 4 | Compound 28 | .02 | 2.07 | 150 |

The results show improved speed and $D_{max}$ as compared to emulsions containing only the conventional gold and sulfur sensitizers.

EXAMPLE 6

Two silver chlorobromide emulsions were prepared as described in Example 2 except that the emulsions were remelted according to Procedure D. The control emulsion contained the conventional gold and sulfur sensitizers indicated therein. There was added to the second emulsion $3.4 \times 10^{-4}$ mole per 1.5 moles of compound 21 plus the gold chloride and sodium thiosulfate of the control. The coated strips were exposed and processed as described in Example 5. The sensitometric results are shown in the following table.

TABLE 6

| Ctg. No. | Additive | $D_{min.}$ | $D_{max.}$ | Dens. at Step 11 |
|---|---|---|---|---|
| 1 | $1.74 \times 10^{-5}$ Sodium thiosulfate (Control) | .03 | .52 | .01 |
| 2 | Control + Compound 21 | .06 | 1.99 | .28 |

The data show that the organophosphine sulfide compound can be used with a conventional sulfur sensitizer to improve the sensitivity of a silver halide emulsion.

EXAMPLE 7

Silver chlorobromide emulsions were made and remelted as described in Procedures A and D above, except that in one emulsion the sulfur sensitizer was omitted. Organophosphine sulfide compounds Nos. 16 and 17 were added during digestion in amounts of $3.4 \times 10^{-4}$ mole per 1.5 moles of silver halide in place of the sodium thiosulfate. The test strips were exposed and processed as described in Example 1. The sensitometric results are shown in the following table.

TABLE 7

| Ctg. No. | Additive | $D_{min.}$ | $D_{max.}$ | Speed Dens. = 1.0 |
|---|---|---|---|---|
| 1 | Cold chloride – Control No sodium thiosulfuate | .03 | .90 | Unmeasurable |
| 2 | Control (Conventional cold chloride + sodium thiosulfate sensitizer) | .03 | 1.09 | 100 |
| 3 | Compound 16 | .03 | 2.18 | 900 |
| 4 | Compound 17 | .05 | 2.78 | 1000 |

The data show increased speeds up to 10 times over that obtained by conventional sulfur sensitizers provided by the use of organophosphine sulfides.

EXAMPLE 8

A gelatino-silver iodobromide emulsion was made according to Procedure B and remelted according to Procedure D wherein only the control contained sodium thiosulfate. All of the emulsions contained gold chloride as indicated in Procedure D.

The test strips were exposed and processed as described in Example 1 and the results are shown in the table.

TABLE 8

| Ctg. No. | Additive | $D_{min.}$ | $D_{max.}$ | Speed Dens. = 1.0 |
|---|---|---|---|---|
| 1 | Control Optimum amount of Conventional Sulfur Sensitizer | .02 | 2.21 | 100 |
| 2 | $3.4 \times 10^{-5}$ Mole Compound 10/1.5 moles of silver halide | .02 | 2.23 | 221 |
| 3 | $3.4 \times 10^{-4}$ Mole Compound 10/1.5 moles of silver halide | .03 | 2.69 | 341 |
| 4 | $1.7 \times 10^{-3}$ Mole Compound 10/1.5 moles of silver halide | .18 | 3.08 | Greater Than 800 |

The data show that the organophosphine sulfides are effective sensitizers over a concentration range from $3.4 \times 10^{-5}$ to $1.7 \times 10^{-3}$ moles per 1.5 moles of silver halide.

EXAMPLE 9

Example 8 was repeated using $1.74 \times 10^{-5}$ mole of sodium thiosulfate and $3.3 \times 10^{-6}$ of gold chloride per 1.5 moles of silver halide according to Procedure D for the Control and $3.4 \times 10^{-4}$ mole per 1.5 mole of silver halide of Compounds 25, 26, 27 and 28 respectively in place of sodium thiosulfate. The strips were exposed and tested as in Example I to give the sensitometric results shown in the table.

TABLE 9

| Ctg. No. | Additive | $D_{min}$ | $D_{max.}$ | Density Step #2 |
|---|---|---|---|---|
| 1 | Control – Sodium Thiosulfuate + Gold Chloride | .04 | 3.19 | .04 |
| 2 | Gold Chloride + Compd. 25 | .04 | 3.43 | .17 |
| 3 | Gold Chloride + Cmpd. 26 | .04 | 3.13 | .95 |
| 4 | Gold Chloride + Cmpd. 27 | .05 | 3.48 | 1.17 |
| 5 | Gold Chloride + Cmpd. 28 | .05 | 3.08 | 1.05 |

EXAMPLE 10

Silver chlorobromide emulsions were made according to Procedure A and remelted according to Procedure D except that one control (Coating 1) contained no sulfur sensitizer while two controls contained $1.74 \times 10^{-5}$ mole of sodium thiosulfate (Coating 2) and $3.4 \times 10^{-4}$ mole of another sulfur sensitizer (Coating 3). Compounds Nos. 23, 24, 26 and 27 were added in amounts of $3.4 \times 10^{-4}$ mole per 1.5 moles of silver halide. All of the emulsions contained the gold chloride indicated in Procedure D. The emulsions were tested as described in Example 1 to give the following sensitometric results.

TABLE 10

| Ctg. No. | Additive Mole per 1.5 moles of Silver Halide | $D_{min.}$ | $D_{max.}$ | Density At Step #2 |
|---|---|---|---|---|
| 1 | Control – Gold chloride No Sodium Thiosulfate | .03 | .90 | .01 |
| 2 | Control + Sodium Thiosulfate | .03 | 2.17 | .42 |
| 3 | Control + $3.4 \times 10^{-4}$ of labile sulfur | .04 | 1.90 | .69 |
| 4 | Compound 23 + $3.4 \times 10^{-4}$ of labile sulfur | .05 | 2.14 | 1.19 |
| 5 | Compound 24 + $3.4 \times 10^{-4}$ of labile sulfur | .21 | 1.96 | .90 |
| 6 | Compound 26 + $3.4 \times 10^{-4}$ of labile sulfur | .09 | 2.45 | .97 |
| 7 | Compound 27 + $3.4 \times 10^{-4}$ of labile sulfur | .06 | 2.43 | 1.23 |

The data show that the organophosphine sulfides are effective sensitizers even when used in conjunction with conventional prior art sulfur sensitizers.

EXAMPLE 11

Silver chlorobromide emulsions were made according to Procedure A and remelted according to Procedure D except that the sulfur sensitizer was omitted in one control emulsion and included in a second control emulsion. All emulsions contained $3.3 \times 10^{-6}$ mole of gold chloride per 1.5 moles of silver halide. To two other emulsions $3.4 \times 10^{-4}$ mole of compounds Nos. 7 and 8 per 1.5 mole of silver halide were added in place of sodium thiosulfate as indicated in the following table. The strips were exposed and processed as described in Example 1. The sensitometric results are shown in the table.

TABLE 11

| Ctg. No. | Additive | $D_{min.}$ | $D_{max.}$ | Density Step #11 |
|---|---|---|---|---|
| 1 | Control (no sodium thiosulfate sensitizer) | .02 | .41 | .21 |
| 2 | Control ($1.74 \times 10^{-5}$ mole sodium thiosulfate) | .03 | .83 | .54 |
| 3 | Compound 7 | .02 | .87 | .39 |
| 4 | Compound 8 | .25 | 1.81 | 1.45 |

EXAMPLE 12

A silver iodobromide emulsion was prepared as described in Procedure B and remelted as in Procedure D except that two controls contained sulfur sensitizers and 3 other coatings contained Compounds 9, 5 and 11 respectively, in amounts as indicated in the table. The strips were exposed and processed as described in Example 1. The sensitometric results are shown below.

TABLE 12

| Ctg. No. | Additive | Amt. per 1.5 moles Silver Halide | $D_{min.}$ | $D_{max.}$ | Speed Dens. = 1.0 |
|---|---|---|---|---|---|
| 1 | Control – Sodium Thiosulfate | $1.74 \times 10^{-5}$ moles | .02 | 2.21 | 100 |
| 2 | Control – labile sulfur | $3.4 \times 10^{-5}$ moles | .02 | 2.10 | 144 |
| 3 | Compound 9 | " | .02 | 2.30 | 204 |
| 4 | Compound 5 | " | .02 | 2.38 | 248 |
| 5 | Compound 11 | " | .02 | 2.47 | 285 |

The data indicate that the organophosphine sulfides show improved sensitivity over the controls.

EXAMPLE 13

A silver chlorobromide emulsion was prepared according to Procedure A and remelted according to Procedure D. The control used a conventional sulfur sensitizer, and a second sample also used a conventional sulfur sensitizer plus $3.4 \times 10^{-4}$ moles of compound 4 per 1.5 moles of silver halide. Samples were exposed and processed as described in Example 1 and the sensitometric results are shown in the following table.

TABLE 13

| Ctg. No. | Additive | Test Age | $D_{min.}$ | $D_{max.}$ | Speed Dens. = 1.0 |
|---|---|---|---|---|---|
| 1 | Control – $1.74 \times 10^{-5}$ mole – sodium thiosulfate | Fresh | .04 | 2.42 | 100 |
| | | Oven | .08 | 2.11 | 72 |
| 2 | Control + Compound 4 | Fresh | .08 | 3.12 | 160 |
| | | Oven | .07 | 2.89 | 137 |

The organophosphine sulfide improves the sensitivity of the photographic material both in the fresh condition and upon aging to a significant degree.

EXAMPLE 14

A silver iodobromide emulsion was prepared as described in Example 1 and remelted as in Procedure D. To similar emulsions there were added in place of sodium thiosulfate, $3.4 \times 10^{-4}$ mole of the Compounds 18, 19, 12, 13, 14, and 15 per 1.5 moles of silver halide. The compounds were added during digestion in Procedure D. The sensitometric tests are shown in the following table.

TABLE 14

| Coating No. | Additive | $D_{min.}$ | $D_{max.}$ | Speed at Dens. = 1.0 |
|---|---|---|---|---|
| 1 | Control | .02 | 1.72 | 100 |
| 2 | Compound 18 | .02 | 2.11 | 182 |
| 3 | Compound 19 | .02 | 2.15 | 135 |
| 4 | Compound 12 | .03 | 1.71 | 245 |
| 5 | Compound 13 | .02 | 1.72 | 240 |
| 6 | Compound 14 | .45 | 1.45 | 1600 |
| 7 | Compound 15 | .02 | 1.48 | 157 |

The organophosphine sulfides improved the sensitivity of the photographic material.

The data clearly indicate that the organophosphine sulfides are effective chemical sensitizers for silver halide emulsions and do not cause a detrimental effect on the stabilization of the system, i.e., fog on shelf storage, tropical aging, etc.

As indicated by the various examples, the organophosphine sulfides of this invention may be used as the sole sensitizer in silver halide systems or they may be used in conjunction with other known sensitizers which do not prevent chemical sensitization, e.g., sulfur and noble metal salt compounds. There may also be used reducing agents, e.g., stannous salts, compounds which sensitize by development acceleration, e.g. polyoxyethylene compounds and the polyhedral boranes disclosed in Bigelow, U.S. Pat. No. 3,779,777 and Bigelow, U.S. Pat. No. 3,761,275. In addition, some optical sensitizing dyes can be used in silver halide emulsion systems which sensitize independently of the organophosphine sulfide compounds of this invention. However, some compounds such as merocyanine dyes, form supersensitizing combinations with the phosphine sulfides. In a supersensitizing combination the compounds mutually provide a sensitization greater than the sum of the sensitizing effects of the individual compounds' optical sensitization. The sensitivity increase, however, is substantially localized in the spectral area wherein the dye confers sensitivity, whereas the effect of chemical sensitization is to increase sensitivity throughout the spectrum, i.e., the area of inherent sensitivity and that conferred by the dye.

Improved photographic elements are provided by the invention comprising a support bearing a least one layer of a photographic silver halide emulsion sensitized according to the invention. Colloid-silver halide emulsions, especially gelatino-silver halide emulsions are particularly preferred. The emulsions may be coated on any suitable support including a sheet support such as photographic quality paper and film. For example cellulose supports, e.g., cellulose acetate, cellulose triacetate, cellulose mixed esters, etc., may be used. Polymerized vinyl compound, e.g., copolymerized vinyl acetate and vinyl chloride, polystyrene and polymerized acrylate may also be mentioned. The film formed from the polyesters made according to the teachings of Alles, U.S. Pat. No. 2,779,684 and the patents referred to in the specifications of that patent may be used. Other suitable supports are the polyethylene terephthalate/isophthalates of British Pat. No. 766,290 and Canadian Pat. No. 562,672 and those obtainable by condensing terephthalic acid and dimethylterephthalate with propylene glycol, diethylene glycol, tetramethylene glycol or cyclohexane-1,4-dimethanol (hexahydro-p-xylene alcohol). The films of Bauer et al., U.S. Pat. 3,052,543 may also be used. The above polyester films are particularly suitable because of their dimensional stability.

I claim:

1. A photographic silver halide emulsion sensitized by digestion at a pH of at least 7 with an organophosphine sulfide added before or during digestion and having the formula $$(X)_m-\overset{\overset{\displaystyle S}{\|}}{P}-(R)_{3-m}$$

wherein (A) R is individually selected from hydrogen and a monovalent organic radical; $m$ is 0, 1 or 2, and not more than one of said R's is hydrogen when $m$ is 0; and X represents a group having the formula:

$$-Z_n-\overset{\overset{\displaystyle S}{\|}}{P}-(R)_2$$

where Z is a divalent organic radical, and $n$ is 0 or 1, or (B) $(x)_m$ and $(R)_{3-m}$ together comprise a single trivalent heterocyclic radical.

2. A photographic silver halide emulsion according to claim 1 wherein R is selected from hydrogen and a monovalent linear aliphatic, heterocyclic, or aryl group.

3. A photographic silver halide emulsion according to claim 1 wherein Z is selected from —NH— and a divalent linear aliphatic group having 1–8 carbon atoms or a cyclic aliphatic group having up to 8 carbon atoms.

4. A photographic element comprising a support bearing a layer of the silver halide emulsion of claim 1.

5. A photographic silver halide emulsion according to claim 1 wherein said organophosphine sulfide is

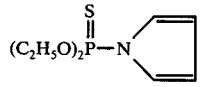

6. A photographic silver halide emulsion according to claim 1 wherein said organophosphine sulfide is $$(C_2H_5)_2\overset{\overset{\displaystyle S}{\|}}{P}-\overset{\overset{\displaystyle S}{\|}}{P}(C_2H_5)_2\,.$$

7. A photographic silver halide emulsion according to claim 1 wherein said organophosphine sulfide is $$(CH_3)_2\overset{\overset{\displaystyle S}{\|}}{P}-\overset{\overset{\displaystyle S}{\|}}{P}(CH_3)_2\,.$$

8. A photographic silver halide emulsion according to claim 1 wherein said organophosphine sulfide is $$(C_6H_5)_3\,P=S$$

9. A photographic silver halide emulsion according to claim 1 wherein said organophosphine sulfide is 1,2-bisdiphenyl phosphino ethane disulfide.

10. A photographic silver halide emulsion according to claim 1 wherein said organophosphine sulfide is diphenylpyrryl phosphine sulfide.

11. A photographic silver halide emulsion according to claim 1 wherein said organophosphine sulfide is $$(C_6H_5)_2\overset{\overset{\displaystyle S}{\|}}{P}-CH_2\overset{\overset{\displaystyle S}{\|}}{P}(C_6H_5)_2\,.$$

12. A photographic silver halide emulsion according to claim 1 wherein said organophosphine sulfide is $$(C_6H_5)_2\overset{\overset{\displaystyle S}{\|}}{P}-H\,.$$

13. A photographic silver halide emulsion according to claim 1 wherein said organophosphine sulfide is

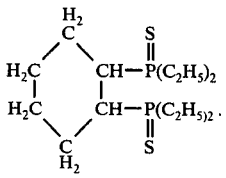

14. A photographic silver halide emulsion according to claim 1 wherein said organophosphine sulfide is

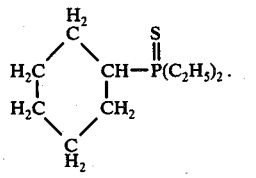

15. A photographic silver halide emulsion according to claim 1 wherein said organophosphine sulfide is

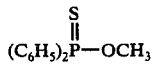

16. A photographic silver halide emulsion according to claim 1 wherein said organophosphine sulfide is

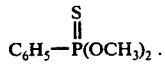

17. A photographic silver halide emulsion according to claim 1 wherein said organophosphine sulfide is

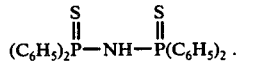

18. A photographic silver halide emulsion according to claim 1 wherein said organophosphine sulfide is

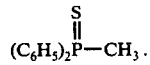

19. A photographic silver halide emulsion according to claim 1 wherein said organophosphine sulfide is

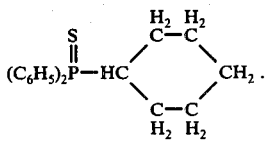

20. A photographic silver halide emulsion according to claim 1 wherein said organophosphine sulfide is $[(CH_3)_2N]_3P=S$ 21. A photographic silver halide emulsion according to claim 1 wherein said organophosphine sulfide is

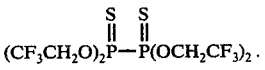

22. A photographic silver halide emulsion according to claim 1 wherein said organophosphine sulfide is

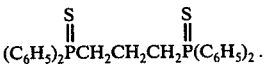

23. A photographic silver halide emulsion according to claim 1 wherein said organophosphine sulfide is

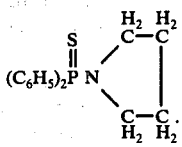

24. A photographic silver halide emulsion according to claim 1 wherein said organophosphine sulfide is

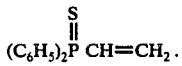

25. A photographic silver halide emulsion according to claim 1 wherein said organophosphine sulfide is $(CH_3CH_2CH_2CH_2O)_3P=S.$ 26. A photographic silver halide emulsion according to claim 1 wherein said organophosphine sulfide is

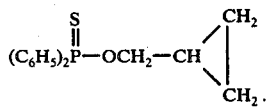

27. A photographic silver halide emulsion according to claim 1 wherein said organophosphine sulfide is

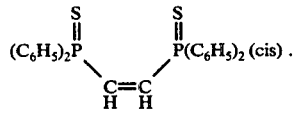

28. A photographic silver halide emulsion according to claim 1 wherein said organophosphine sulfide is

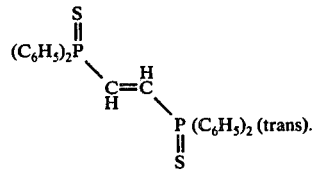

29. A photographic silver halide emulsion according to claim 1 wherein said organophosphine sulfide is

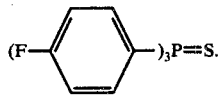

30. A photographic silver halide emulsion according to claim 1 wherein said organophosphine sulfide is

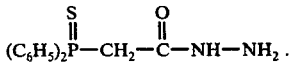

31. A photographic silver halide emulsion according to claim 1 wherein said organophosphine sulfide is $$(C_6H_5)_2\overset{\overset{\displaystyle S}{\|}}{P}-CH_2CH_2Cl.$$

32. A photographic silver halide emulsion according to claim 1 wherein said organophosphine sulfide is

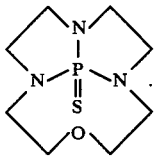

33. A photographic silver halide emulsion according to claim 1 wherein said organophosphine sulfide is

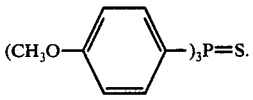

34. A photographic silver halide emulsion according to claim 1 wherein said organophosphine sulfide is $$(C_6H_5)_2\overset{\overset{\displaystyle S}{\|}}{P}-\overset{\overset{\displaystyle S}{\|}}{P}(C_6H_5)_2.$$

35. A photographic silver halide emulsion according to claim 1 wherein said organophosphine sulfide is $$C_6H_5-\overset{\overset{\displaystyle S}{\|}}{P}(CH_2CH_2\overset{\overset{\displaystyle S}{\|}}{P}(C_6H_5)_2)_2.$$

* * * * *